US007712328B2

(12) United States Patent
Harris

(10) Patent No.: US 7,712,328 B2
(45) Date of Patent: May 11, 2010

(54) REFRIGERATOR AND APPLIANCE SYSTEM WITH ICE AND WATER DISPENSING ASSEMBLIES ACCESSIBLE FROM MULTIPLE SIDES

(76) Inventor: Teresa L. Harris, 201 SE. 89th St., Apt. # 706, Oklahoma City, OK (US) 73149

( * ) Notice: Subject to any disclaimer, the term of this patent is extended or adjusted under 35 U.S.C. 154(b) by 753 days.

(21) Appl. No.: 11/366,708

(22) Filed: Mar. 2, 2006

(65) Prior Publication Data

US 2007/0204643 A1 Sep. 6, 2007

(51) Int. Cl.
*F25C 5/18* (2006.01)

(52) U.S. Cl. ..... 62/344; 62/266; 62/389; 62/390; 221/68; 221/252; 312/286; 312/287

(58) Field of Classification Search ..... 62/344, 62/389, 390, 266, 66; 221/68, 252; 312/405, 312/287, 286

See application file for complete search history.

(56) References Cited

U.S. PATENT DOCUMENTS

| | | | | |
|---|---|---|---|---|
| 4,090,641 | A | 5/1978 | Lindenschmidt | |
| 4,626,049 | A | 12/1986 | Gross et al. | |
| 4,725,107 | A | 2/1988 | Appleton | |
| 4,958,749 | A | 9/1990 | Kuenzel et al. | |
| 5,267,672 | A | 12/1993 | Jacobsen et al. | |
| 5,359,795 | A | 11/1994 | Mawby et al. | |
| 5,442,933 | A * | 8/1995 | Unger | 62/275 |
| 5,526,854 | A | 6/1996 | Unger | |
| 5,542,573 | A * | 8/1996 | Frantz | 222/129.1 |
| 5,921,191 | A | 7/1999 | Gabel | |
| 6,079,216 | A * | 6/2000 | de Marsillac Plunkett et al. | 62/56 |
| 6,135,173 | A | 10/2000 | Lee et al. | |
| 6,415,552 | B1 | 7/2002 | Khosropour | |
| 6,425,425 | B2 | 7/2002 | Bianchi et al. | |
| 6,442,960 | B1 | 9/2002 | Fournier et al. | |
| 6,484,531 | B1 * | 11/2002 | Hambleton et al. | 62/440 |
| 6,533,003 | B1 | 3/2003 | Jacobus et al. | |
| 6,561,691 | B1 * | 5/2003 | McCann et al. | 366/299 |
| 6,626,213 | B2 | 9/2003 | Maritan et al. | |
| 6,708,509 | B1 | 3/2004 | Senner | |
| 6,751,525 | B1 | 6/2004 | Crisp, III | |
| 6,810,682 | B1 | 11/2004 | Schuchart et al. | |
| 6,848,600 | B1 | 2/2005 | Crisp, III | |

* cited by examiner

*Primary Examiner*—Cheryl J Tyler
*Assistant Examiner*—Justin Loffredo
(74) *Attorney, Agent, or Firm*—Dunlap Codding, P.C.

(57) ABSTRACT

A refrigerator having an ice and beverage dispenser on both the front and the back of the refrigerator improves efficiency and utilization of the refrigerator. Home floor plans include passageways through interior walls whereby a user can access a second dispenser of the kitchen refrigerator from an adjacent room, thus increasing access to the refrigerator.

4 Claims, 7 Drawing Sheets

REFRIGERATOR AND APPLIANCE SYSTEM WITH ICE AND WATER DISPENSING ASSEMBLIES ACCESSIBLE FROM MULTIPLE SIDES

BACKGROUND OF THE INVENTION

This invention relates generally to appliances and, more particularly, to refrigerators including refrigerator-freezer combinations that provide storage accessibility and dispensing capability from more than one side of the refrigerator.

A refrigerator is a large cabinet unit used to keep food and drinks cool and fresh. The majority of homes have a predefined refrigerator area into which a refrigerator-freezer unit is inserted and, typically, access to the refrigerator is limited to the area directly in front of the refrigerator. This makes it difficult for more than one person to access the refrigerator at the same time. Thus, growing families and large residential group homes often have traffic jams at the refrigerator where several people at the same time are attempting to obtain a cold drink or open the doors to retrieve something inside.

In recent years, refrigerators have been designed with through-the-door ice and beverage dispensers. These units are not only convenient for the user, but they also conserve energy by allowing access to ice and water without opening a refrigerator door, thereby maintaining a constant temperature and not causing warm, moist air to enter or cold air to escape the refrigerator. Typically, consumer ice dispensers are located in a freezer compartment door and have a damper door that restricts warm moist air from entering the freezer compartment. The user requests crushed or cubed ice by exerting pressure against a switch mechanism, usually with a drinking glass, which causes the damper door to remain open. When the glass is sufficiently full, the user removes the pressure from the mechanism and the damper door closes. The user can also procure refrigerated or chilled water using a similar procedure after manually setting an electric switch to the beverage mode. However, while such units are convenient and conserve energy, they do not significantly increase accessibility to the refrigerator.

What is needed is a refrigerator design that increases accessibility to the refrigerator while maintaining the energy efficiency achieved with the through-the-door ice and beverage dispensers.

SUMMARY OF THE INVENTION

By the present invention, a refrigerator is provided which meets the above described needs and overcomes the deficiencies of the prior art. A refrigerator of the present invention has a freezer compartment within the interior of the refrigerator that has a source of ice, a first ice dispenser assembly disposed in a first side of the refrigerator and in communication with the source of ice, and a second ice dispenser assembly disposed in a second side of the refrigerator also in communication with the source of ice.

In other embodiments of this invention, the first ice dispenser assembly is disposed in a front door on the front of the refrigerator, and the second external ice dispenser assembly is disposed in the back side of the refrigerator. A rotatable auger is mounted within the ice storage bin and adapted to advance the ice contained therein. Depression of a first switch causes the auger to rotate in a direction advancing ice toward a passage connecting the bin with the first ice dispenser. Depression of a second switch causes the auger to rotate in the opposite direction advancing ice toward a second passage connecting the bin with the second ice dispenser.

An appliance system of the present invention comprises a wall, in a building or home, preferably an interior wall, wherein the wall provides a division between a first area and a second area. A passageway through the wall provides access to the first area from the second area, and a refrigerator is positioned in the first area adjacent to the passageway. A first ice dispenser assembly is disposed in a first side of the refrigerator and is accessible by a user standing in the first area. The position of the refrigerator is such that a second ice dispenser assembly disposed in a second side of the refrigerator is accessible to a user standing in the second area via the passageway through the interior wall.

The methods for providing ice in a building or home basically comprise the following steps. A passageway is provided through a wall dividing a first area from a second area. A refrigerator as described above is located in the first area adjacent the passageway and having the first ice dispenser accessible to a user in the first area. The refrigerator is further aligned such that the second external ice dispenser is accessible to a user in the second area through the passageway through the wall. The user, reaching through the passageway, then manually activates a switch on the second side of the refrigerator causing the second ice dispenser to dispense ice into a container held by the user.

Other features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a top view of an ice dispensing system of and embodiment of the present invention.

DESCRIPTION OF THE PREFERRED EMBODIMENTS

Figure 1:
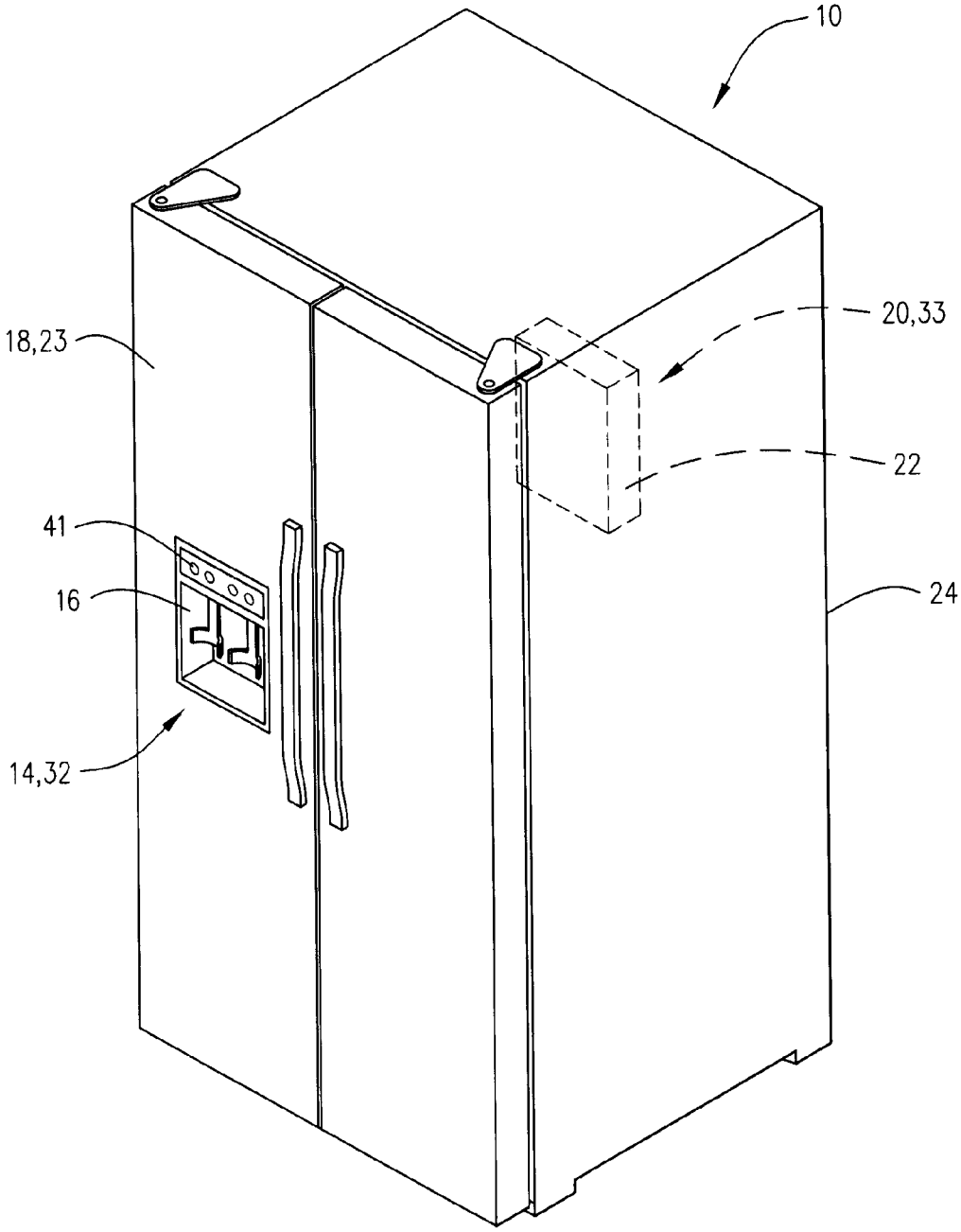
FIG. 1 is a perspective view of a refrigerator of the present invention.

A refrigerator of the present invention is illustrated generally in FIG. 1. The refrigerator basically includes two or more ice dispensing assemblies disposed in different sides of the refrigerator, and thus has significantly increased user-accessibility while maintaining energy efficiency.

Figure 2:
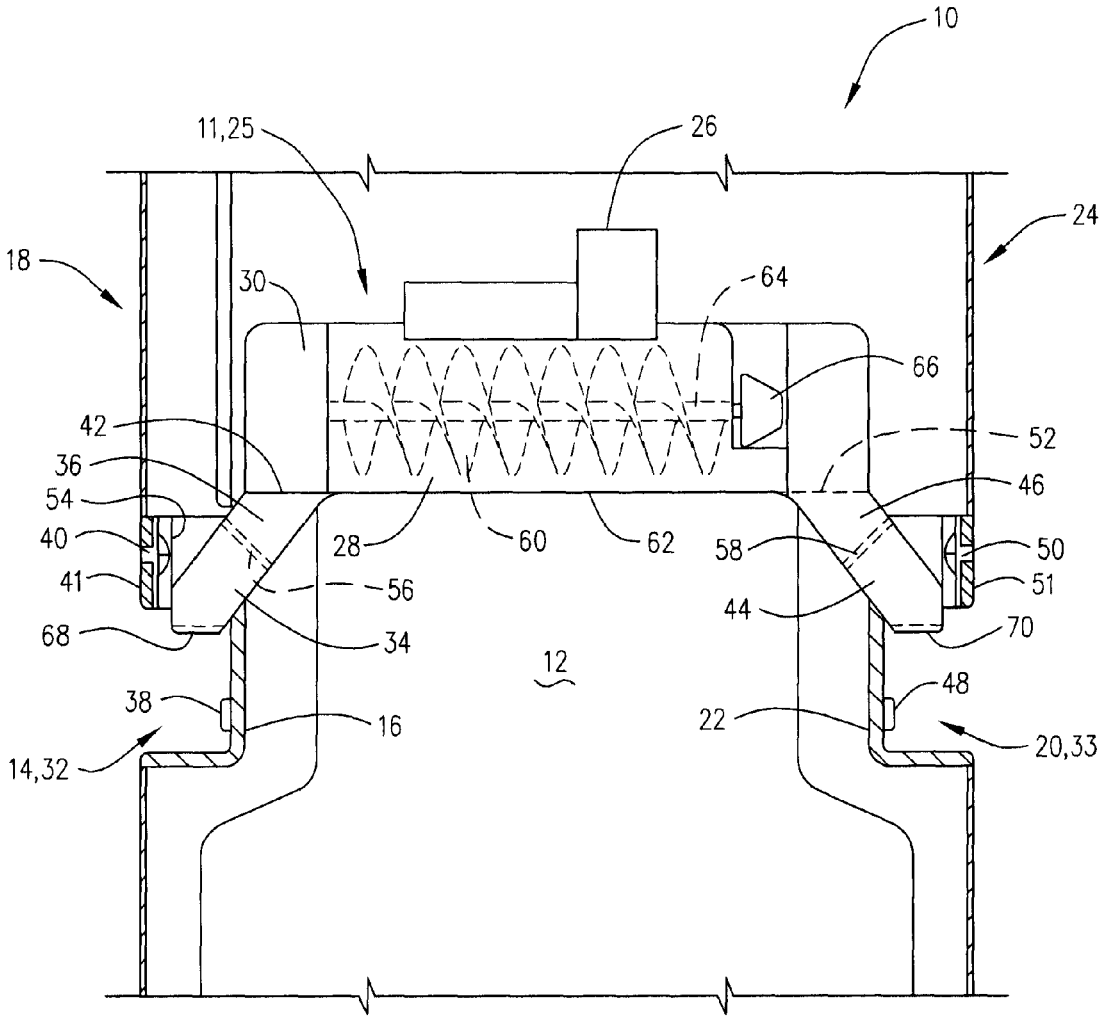
FIG. 2 is a plan view of ice dispensing system of the present invention.

Referring now to FIGS. 1 and 2, a refrigerator 10 of this invention includes an ice source 11 within a freezer compartment 12 of the refrigerator 10, and two or more external ice dispensing assemblies such as first external dispenser assembly 14 located in a first dispenser recess 16 in a first side 18 of the refrigerator 10, and second external dispensing assembly 20 located in a second dispenser recess 22 in a second side 24 of the refrigerator. Each ice dispenser assembly is provided ice by an internal assembly 25. Preferably, the first side 18 and second side 24 refer to the front and the back of the refrigerator, respectively. More preferably, the first dispenser recess 16 is located on the front of the freezer door 23. While the second dispenser recess 22 is preferably located at the back of the refrigerator opposite the freezer door 23, it can also be located on a side adjacent to the front.

The present invention is not limited to refrigerators having only two external ice dispenser assemblies. For example, a refrigerator of this invention may comprise a side-by-side refrigerator/freezer having an ice dispenser assembly in the front freezer door, a back freezer door also having an ice dispenser assembly, and another dispenser assembly in the side wall adjacent the freezer compartment 12.

Freezer compartment 12 of FIG. 2 is typically a vertical section of the refrigerator 10 as in the side-by-side unit shown in FIG. 1; however the present invention is not limited to this type design and encompasses any design refrigerator having a section available for freezing and/or maintaining frozen ice. The ice source 11 includes any container or storage bin holding crushed or uncrushed ice cubes. Preferably, the two or more external ice dispenser assemblies are provided ice by internal assembly 25 which includes a storage bin 28 and an ice maker 26. More preferably ice maker 26 is an automatic type. It is common practice to provide refrigerators with an ice maker linked to a water supply line (not shown) which is used to fill an internal ice cube tray (also not shown) which is then emptied into the storage bin 28 following a freezing cycle. A first ice crusher unit 30 is preferably installed on the storage bin 28 near the first side 18 of the refrigerator and is capable of delivering either crushed or uncrushed ice cubes. Design and operation of such ice makers and ice crushers are well known to those skilled in the art.

Typically the user inserts a container such as a cup or glass into a dispenser recess and uses the container to exert pressure against a switch to activate the ice dispenser. Using the refrigerator of this invention, a user can obtain ice from the first side 18 by pressing a cup against first switch 38 disposed toward the back of first dispenser recess 16, or can access the refrigerator from the second side 24 and obtain ice by pressing a glass against second switch 48 disposed toward the back of second dispenser recess 22.

The bottom of storage bin 28 comprises a trough 62 which directs the ice to one or one or more rotatable augers (such as auger 60 in FIG. 2 or first auger 60 and second auger 60' in FIG. 6) which are used to move the ice to the activated dispenser. Preferably, a single rotatable auger 60 is used which rotates in a first direction to move the ice toward the front of the refrigerator, and rotates in the opposite direction to move the ice to the back of the refrigerator. Preferably, an auger shaft 64 is rotated by a drive motor 66 which is activated by either first switch 38 or second switch 48. When activated by first switch 38, the motor causes auger 60 to rotate in a forward rotation advancing ice toward the ice storage bin first exit 42 leading to first passage 36. A damper door 56 opens to allow the ice in first passage 36 to advance through first opening 34 and to exit the dispenser through first bottom opening 68. In addition, when drive motor 66 is activated by second switch 48, the motor causes auger 60 to rotate in a reverse rotation advancing ice toward the ice storage bin second exit 52 leading to second passage 46. A second damper door 58 opens to allow the ice in second passage 46 to advance through second opening 44 and to exit the dispenser through second bottom opening 70. A controller 54 is electrically connected to the first and second switches, 38 and 48. The controller 54 includes a delaying means to delay operation of the rotatable auger in the forward direction when it is actively operating in the reverse direction, and to delay operation in the reverse direction when it is actively operating in the forward direction. Such controllers are readily available commercially and their design, installation, and operation are well known to those skilled in the art.

In another embodiment of this invention, refrigerator 10 includes a beverage dispenser 32 located in first dispenser recess 16 in the first side 18 of the refrigerator 10, and a second beverage dispenser 33 located in the second dispenser recess 22 in the second side 24 of the refrigerator 10. A user can access the first beverage dispenser 32 at the first dispenser recess 16 and another user can simultaneously access the second beverage dispenser 33 at the second dispenser recess 22. Preferably the beverage dispensers dispense cooled or chilled water. More preferably, refrigerator 10 is equipped with both first and second ice dispensing assemblies, 14 and 20 respectively, and with both first and second beverage dispensers, 32 and 33 respectively.

First and second control assemblies, 40 and 50 respectively, are preferably located proximate the respective first and second ice and beverage dispenser assemblies, and are manually operated to initiate dispensing of ice or a beverage. Typically a dispenser selection panel allows the user to select a dispensing mode from optional modes such as ice cubes, crushed ice, and a chilled beverage or water. Design of such control assemblies and selection panels is well known to those skilled in the art. In the present invention, a first selection panel 41 is located near the first external dispensing assembly 14 and allows the user to select between operation of the first external dispensing assembly 14 or beverage dispenser 32. A second selection panel 51 with the same or similar selection modes and operation is located near the second external dispensing assembly 20.

Figure 3:
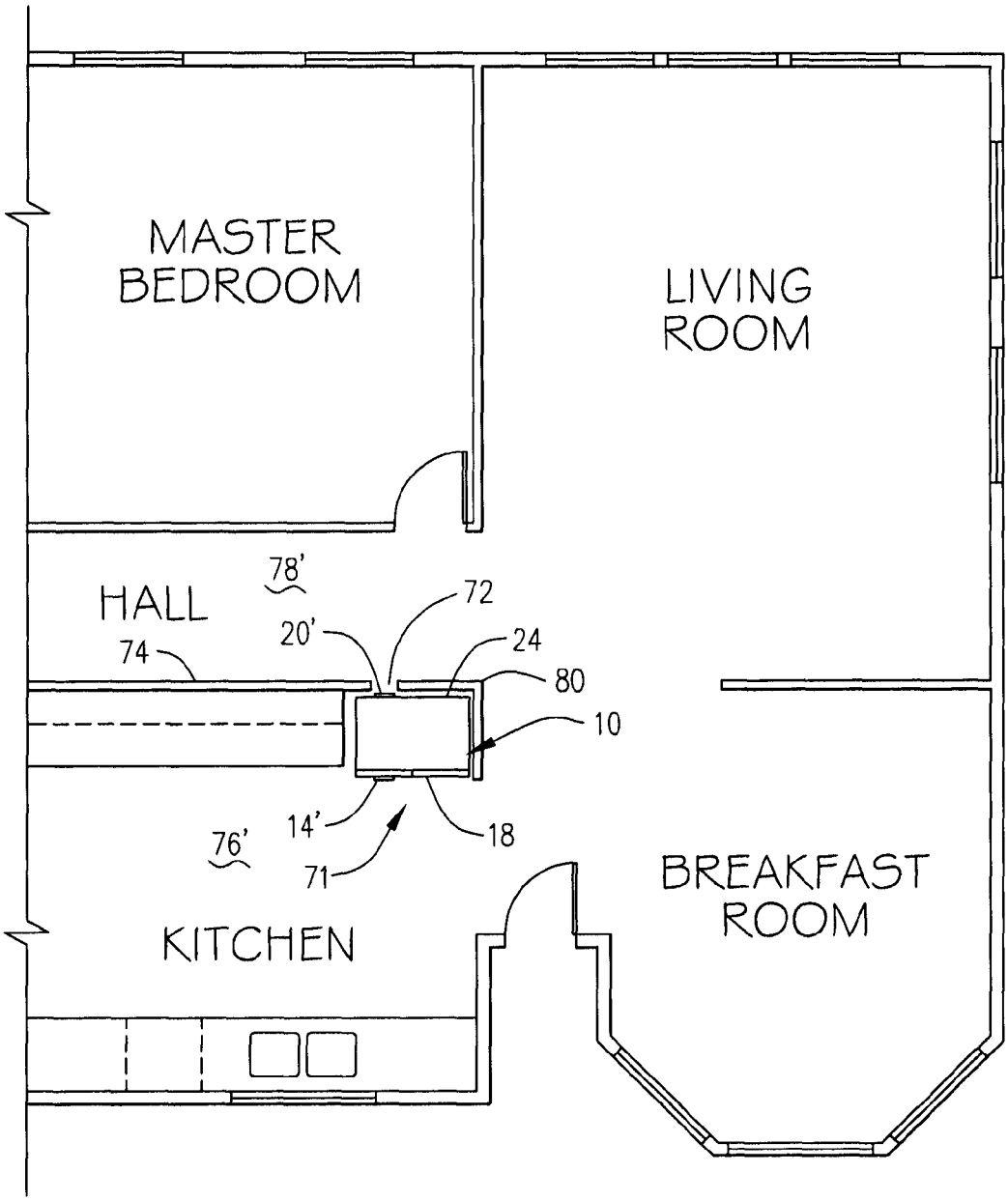
FIG. 3 is an example floor plan of the present invention.

Referring now to FIGS. 2 and 3, appliance systems 71 of this invention of this invention comprise a wall 74 in a building providing a division between a first area 76 and a second area 78. Passageway 72 through wall 74 provides access to first area 76 from second area 78. Refrigerator 10 is positioned in first area 76 adjacent passageway 72 such that first ice dispenser assembly 14 is accessible to a user standing in first area 76 and second ice dispenser assembly 20 is accessible to a user standing in the second area 78 by reaching the user's hand into the passageway 72 through the wall 74.

Preferably wall 74 is an interior wall. Wall 74 is constructed by methods known to those skilled in the art and the construction and composition of the wall is not critical to the invention; however, the wall is preferably either fabricated with a passage, or is fabricated in a conventional manner or such that construction of a passage presents no significant difficulty. Wall 74 can be located in any type of building, but is preferably in a home or domicile.

A suitable passageway 72 may comprise any conduit through wall 74. Preferably the conduit approximates the size of the second dispensing assembly and is positioned in height to align with the second dispensing assembly. The shape of the conduit is not critical, but the size and shape must accommodate an adult-size hand and arm as well as a drinking glass. Preferably the conduit is esthetically pleasing and has an internal height or diameter in a vertical plane of at least 7 inches. Alternatively, a suitable passageway may be provided by having a low interior wall 74 such as "waist-high" wall separating a walkway or wet bar from the kitchen. A "waist-high" wall preferably has a height (from the floor) in the range of about 2½ feet to 4 feet, and more preferably has a height in the range of about 3 to 3½ feet. Since most commercial refrigerators traditionally attach cooling coils over much of the back side of the refrigerator, the appliance system of this invention utilizing a "waist high" wall preferably limits the location of cooling coils to below "waist-height" in the back of the refrigerator, and may add cooling coils to another area such as the underside of the refrigerator. More preferably, the refrigerator comprises a cover plate covering the condenser coils on the back of the refrigerator and a fan providing air circulation to the covered space.

First area 76 can be any area within the building, but is preferably a kitchen area. Nonlimiting examples of suitable second areas 78 include, but are not limited to, halls or hallways, bedrooms, living rooms, family rooms, breakfast rooms, patios and sunrooms.

The methods for providing ice in a building or home basically comprise the following steps. A passageway 72 is provided through a wall dividing a first area from a second area. Refrigerator 10 as described above is located in the first area adjacent the passage and having the first ice dispenser accessible to a user in the first area. The refrigerator is further aligned such that the second external ice dispenser is accessible to a user in the second area via the passage through the wall. The user, reaching through the passageway, then manually activates a switch on the second side of the refrigerator causing the second ice dispenser to dispense ice into a container held by the user.

In order to further illustrate the systems, devices and methods of the present invention, the following hypothetical examples are given.

EXAMPLE 1

The following hypothetical example illustrates the versatility of the invention and specifically the advantages of dispensing ice and cold beverages from multiple sides of a refrigerator. Referring now to FIG. 3, a homeowner purchased refrigerator 10 having a front through-the-door ice and beverage dispenser 14' as well as an ice and beverage dispenser 20' in the back. The refrigerator 10 was located in a typical position in a home having a typical floor plan. However, the homeowner created an additional access to the back dispenser 20 by cutting a section from the wall 74 behind the refrigerator creating a small rectangular passageway 72 from the kitchen 76' to the hall 78'. The cross-sectional center of the passageway was 3 feet 6 inches from the floor and 2 feet 8 inches from a corner 80, which allowed final positioning of the refrigerator such that the back dispenser 20' aligned nearly perfectly with passageway 72. In other words, when the refrigerator was in the desired position, the cross sectional center of the back dispenser 20' was also 3 feet 6 inches from the floor and 2 feet 8 inches from corner 80. The cross section of the passageway was just large enough to allow an approximately one inch border to be exposed around the outer edge of the back dispenser. The passageway 72 was then framed, replastered and painted to match the wall outer surface.

The back dispenser was frequented by family members using the master bedroom, the living room and the breakfast room. This appliance system and arrangement allowed easier access to the dispenser without requiring members and guests to enter the kitchen.

EXAMPLE 2

Figure 4:
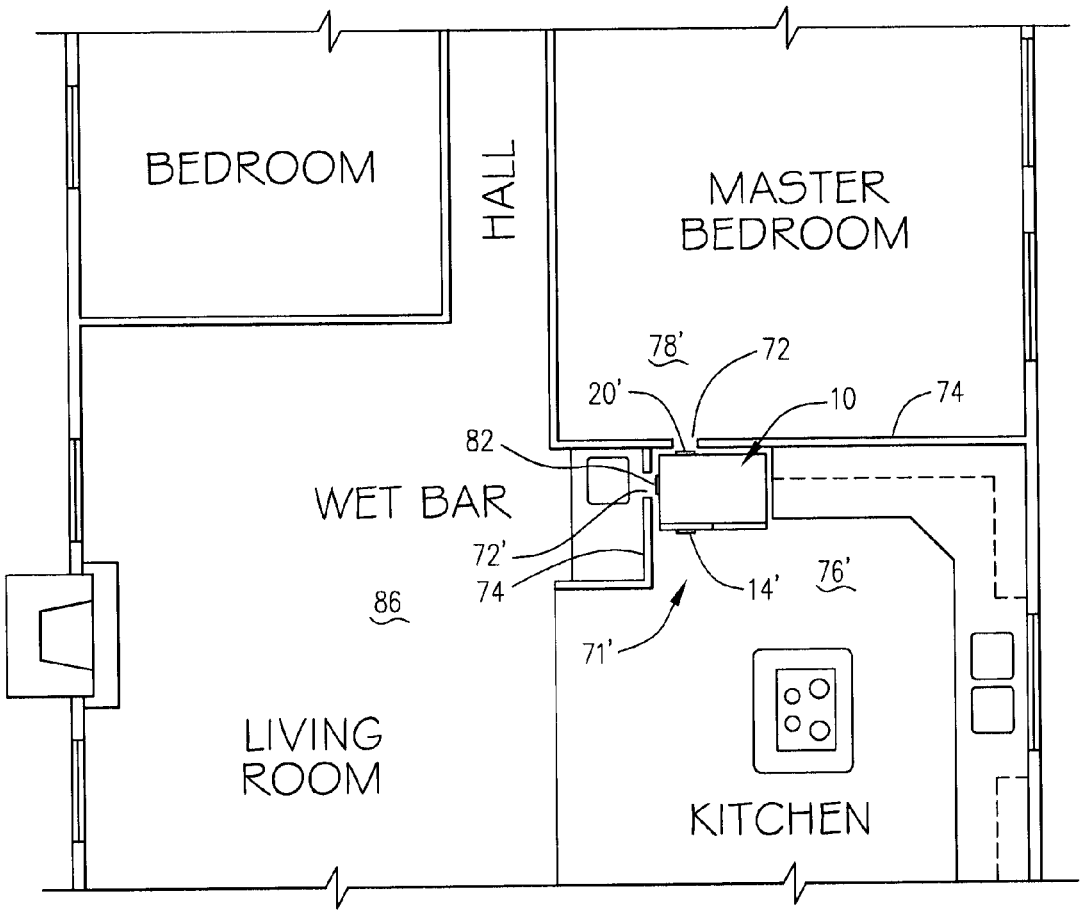
FIG. 4 is a second example floor plan of the present invention.

The following hypothetical example illustrates another embodiment of the refrigerator and appliance system of the present invention. Referring now to FIG. 4, a homeowner purchased refrigerator 10 having a front through-the-door ice and beverage dispenser 14', an ice and beverage dispenser 20' in the back, and a third ice and beverage dispenser 82 on the side. As shown, this home had a wet bar located in a living room 86 away from the kitchen area 76'. The rear mounted ice and cold water dispenser was accessible from the master bedroom 78' via a passageway 72 through the bedroom wall into the kitchen aligned with the dispenser 20' similar to that described in the previous example. The wet bar counter top was about 3 ft high and the side mounted ice and water dispenser was accessed from the wet bar by reaching through an open wall/partition space 72' similar to a kitchen pass-through window.

Figure 5:
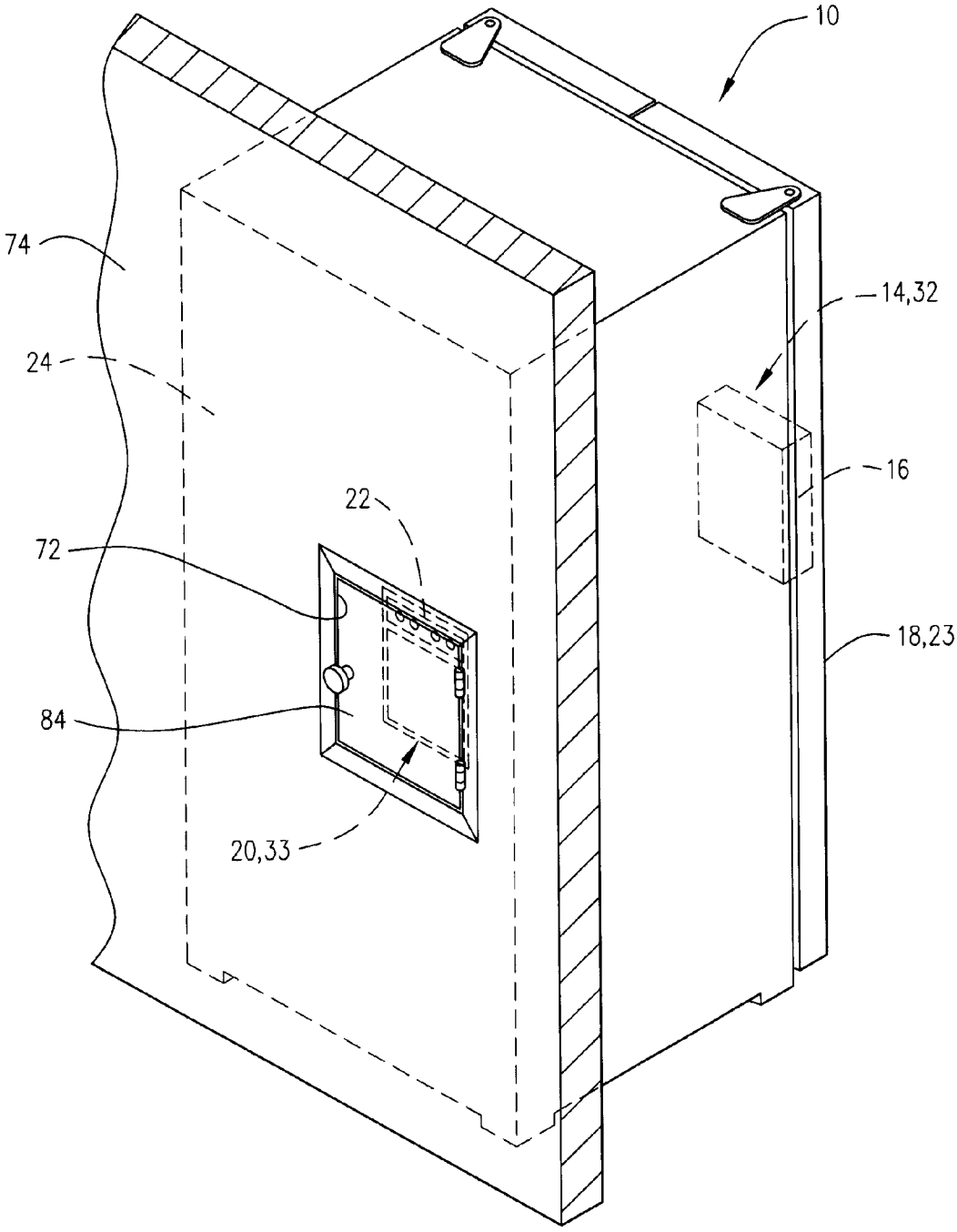
FIG. 5 is a perspective view of the appliance system of the present invention.
Figure 5:
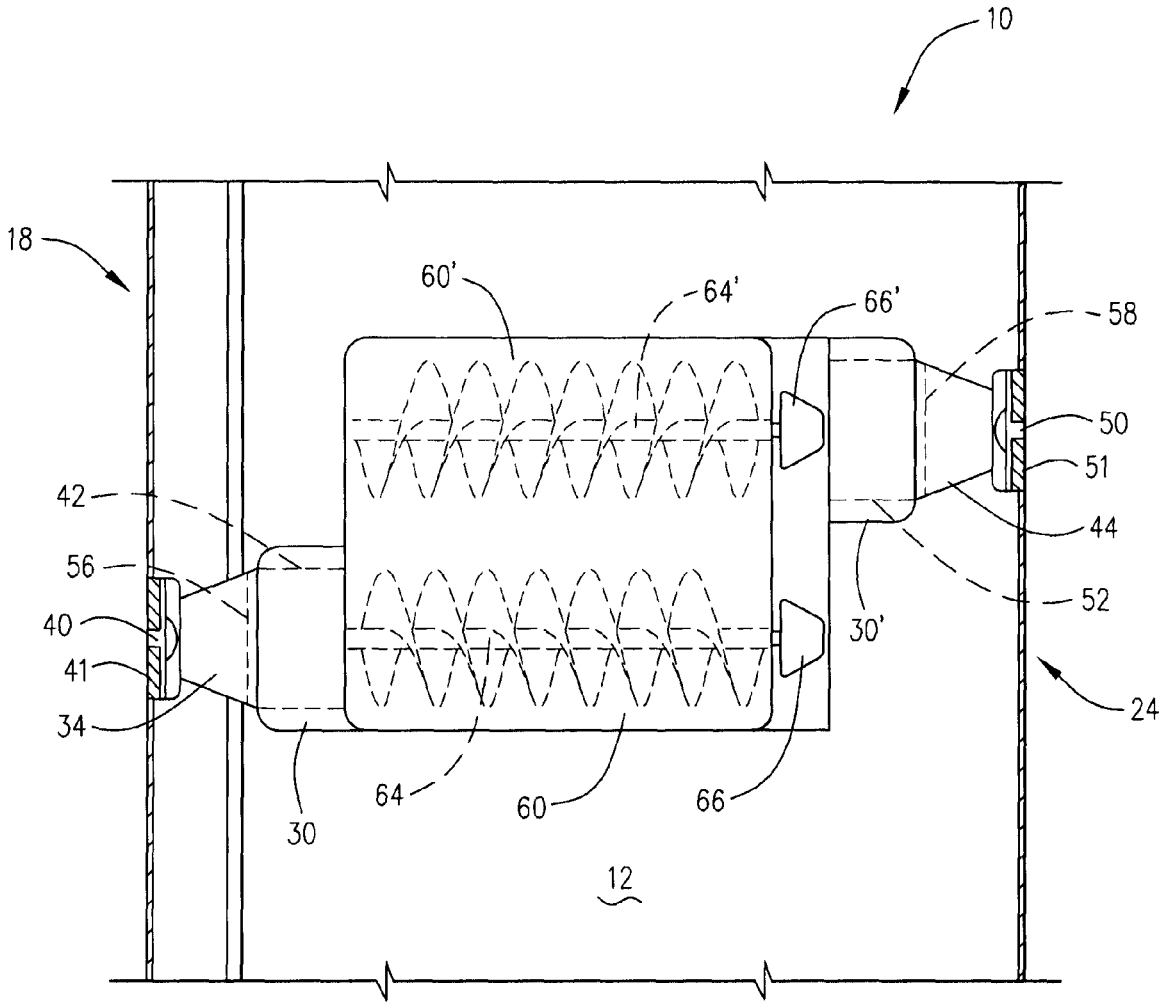

The passageway 72 between kitchen 76' and bedroom 78' was further modified as shown in FIG. 5. The passageway 72 was hidden from view by installing a small door 84 attached to the wall 74. The door 84 not only offered an attractive alternative to the open passageway, but when closed it also prevented heat from the kitchen and back of the refrigerator from entering the bedroom. The door 84 can be added using various techniques known to those skilled in the art. Nonlimiting examples include attaching a wooden frame (not shown) to the wall surrounding the passageway by anchoring the frame to studs within the wall; the door 84 can then be hinged to the frame. Alternatively, a sleeve (not shown) may be inserted through the passageway and a door attached directly to the sleeve.

Figure 7:
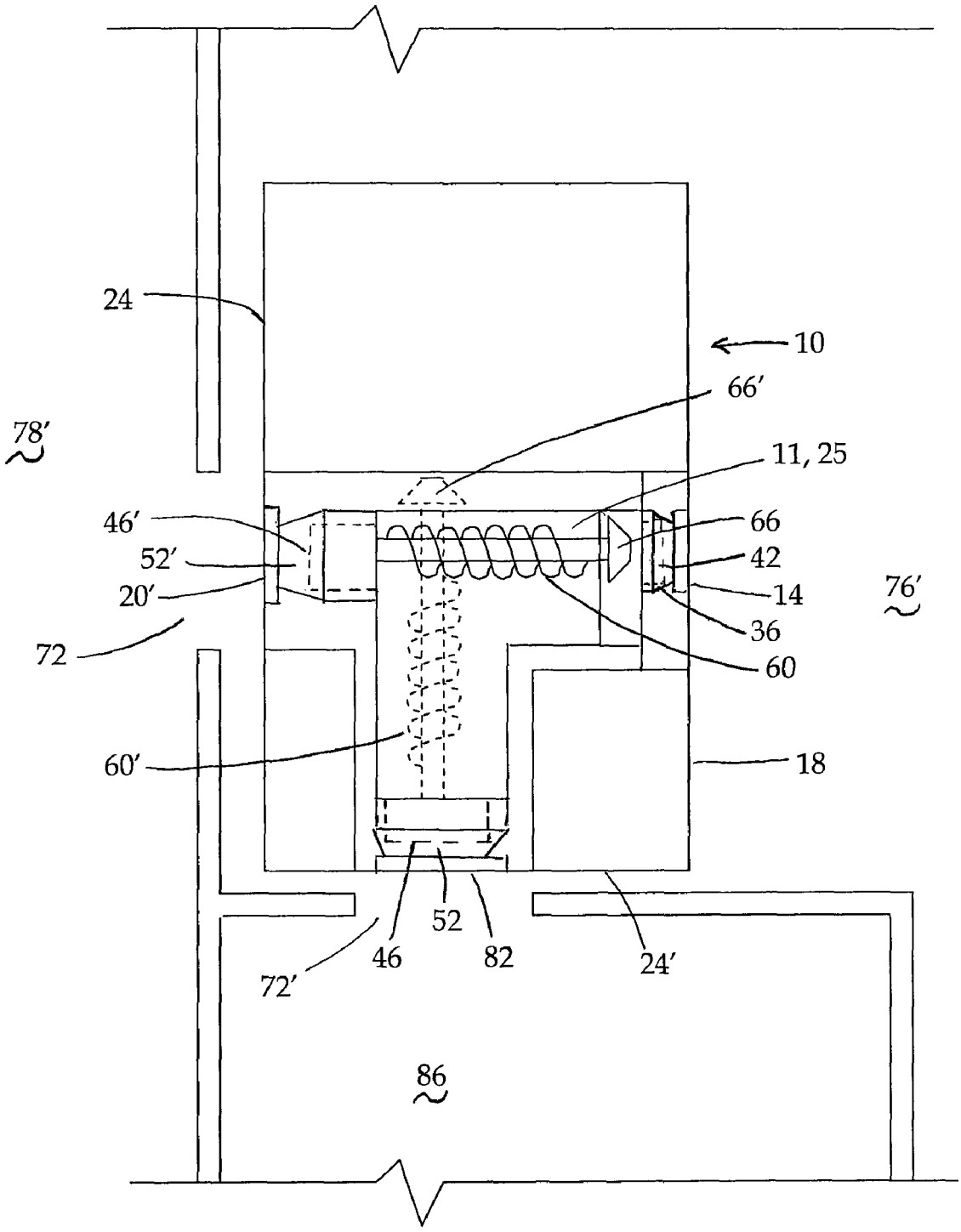
FIG. 7 is a top view of an embodiment of the refrigerator of FIG. 2 positioned as in the floor plan of FIG. 4.

The rear and front ice dispensers 20' and 14, respectively, utilize a single auger 60 rotatable in a forward rotating direction or a reverse rotating direction to advance the ice toward either the front or back dispenser. The side ice dispenser 82 utilizes one of numerous techniques available and known to those skilled in the art of solids handling to advance the ice cubes to the dispenser area. Nonlimiting examples of suitable techniques include use of a second auger, and use of a gate with a single auger. For example, a second auger 60' is positioned in the storage bin as shown in FIG. 7, in this case perpendicular to and above the first auger 60 rather than parallel with auger 60 as shown in FIG. 6. The auger blades are removed or shortened from the overlapping sections of the auger shafts so the augers can be positioned closer together. The second auger 60' advances ice for the side dispenser 82 serving the wet bar patrons. Alternatively, a single auger advances ice toward a user-activated gate (not shown) which diverts the ice cubes to the passage for the side dispenser.

EXAMPLE 3

Another embodiment of the refrigerator and appliance system of the present invention is illustrated by the following hypothetical example. A countertop size refrigerator-freezer referred to as a cube refrigerator, available commercially and manufactured by Avanti Products, Sanyo, Haier, GE and others, was modified to be rear accessible by removing the back and adapting the refrigerator to accept a back door that was the same or similar to the front door. In addition to allowing easier access, this design solves the problem of frozen treats or refrigerated drinks or foods being located toward the back in a difficult to reach location, causing frozen foods to often receive freezer burn and fresh foods to spoil due to lack of attention. The front door and the back door were further modified to include through-the-door front and back ice and beverage dispensers.

The resulting cube refrigerator was then placed on a breakfast bar such that the front faced the kitchen and the back faced toward people sitting at the bar. The refrigerator design and placement allows all the refrigerated storage and dispensing aspects of the appliance to be freely utilized. Now, people working in the kitchen, as well as people sitting on the opposite side of the bar, can readily access the contents of the cube refrigerator and can get ice and/or a beverage from the dispenser.

Thus, the present invention is well adapted to attain the objects and advantages mentioned as well as those that are inherent therein. While numerous changes may be made by those skilled in the art, such changes are encompassed within the spirit of this invention as defined by the appended claims.

What is claimed is:

1. A refrigerator comprising:

a freezer compartment within an interior of the refrigerator, the compartment having an ice storage bin, which is a source of ice;

a front ice dispenser assembly disposed in a front side of the refrigerator and in communication with the source of ice; and a side ice dispenser assembly disposed in an edge side of the refrigerator and in communication with the source of ice;

a first passage connecting a first ice storage bin exit with the front ice dispenser assembly;

a second passage connecting a second ice storage bin exit with the side ice dispenser assembly;

a first switch;

a first rotatable auger mounted within the ice storage bin, activated by the first switch to advance ice contained within the storage bin to the first passage;

a second switch;

a second rotatable auger mounted within the ice storage bin positioned essentially perpendicular to, and in an operably horizontal plane with, the first rotatable auger, the second rotatable auger activated by the second switch to advance ice contained within the storage bin to the second passage.

2. The refrigerator of claim 1, further comprising:

a back ice dispenser assembly disposed in a back side of the refrigerator and in communication with the source of ice; and a third passage connecting a third ice storage bin exit with the back ice dispenser assembly; and a third switch, wherein the first rotatable auger is activated by the third switch to operate in a reverse rotation and advance ice contained within the storage bin to the third passage.

3. In a building including a first wall providing a division between a first area and a second area, and a second wall providing a division between the first area and a third area, an appliance system comprising:

a rear passageway through the first wall providing access to the first area from the second area;

a side passageway through the second wall providing access to the first area from the third area; and a refrigerator positioned in the first area adjacent both the rear and side passageways, wherein the refrigerator comprises the following: (a) a freezer compartment within an interior of the refrigerator and having an ice storage bin, which is a source of ice; (b) a front ice dispenser assembly disposed in a front side of the refrigerator and accessible to a user standing in the first area; (c) a back ice dispenser assembly disposed in a back side of the refrigerator directly opposing the front side of the refrigerator and accessible to a user standing in the second area via the first passageway through the first wall; and (d) a side ice dispenser assembly disposed in an edge side of the refrigerator, the edge side being substantially perpendicular to the front and back sides of the refrigerator, the side ice dispenser accessible to a user standing in the third area via the second passageway through the second wall.

4. The appliance system of claim 3, wherein the refrigerator further comprises:

a first passage connecting a first ice storage bin exit with the front ice dispenser assembly;

a second passage connecting a second ice storage bin exit with the side ice dispenser assembly;

a third passage connecting a third ice storage bin exit with back ice dispenser assembly;

a first switch;

a first rotatable auger mounted within the ice storage bin, activated by the first switch to advance ice contained within the storage bin to the first passage;

a second switch;

a second rotatable auger mounted within the ice storage bin positioned essentially perpendicular to, and in an operably horizontal plane with, the first rotatable auger, the second rotatable auger activated by the second switch to advance ice contained within the storage bin to the second passage; and a third switch, wherein the first rotatable auger is activated by the third switch to operate in a reverse rotation and advance ice contained within the storage bin to the third passage.

* * * * *